US007903066B2

(12) United States Patent
Weng et al.

(10) Patent No.: US 7,903,066 B2
(45) Date of Patent: Mar. 8, 2011

(54) IMAGE PROCESSING DEVICE AND METHOD THEREOF AND IMAGE DISPLAY DEVICE

(75) Inventors: Ruey-Shing Weng, Kaohsiung (TW); Shin-Tai Lo, Miaoli County (TW); Ching-Fu Hsu, Taichung County (TW); Jyun-Sian Li, Tainan (TW)

(73) Assignee: Wintek Corporation, Taichung (TW)

( * ) Notice: Subject to any disclaimer, the term of this patent is extended or adjusted under 35 U.S.C. 154(b) by 734 days.

(21) Appl. No.: 11/937,508

(22) Filed: Nov. 9, 2007

(65) Prior Publication Data

US 2008/0211757 A1 Sep. 4, 2008

Related U.S. Application Data

(60) Provisional application No. 60/864,977, filed on Nov. 9, 2006.

(51) Int. Cl.
*G09G 3/36* (2006.01)

(52) U.S. Cl. ..... 345/89; 345/87; 348/254

(58) Field of Classification Search ..... 345/87–89, 345/102, 204; 348/254, 571, 671, 674, 675
See application file for complete search history.

(56) References Cited

U.S. PATENT DOCUMENTS

| | | | | |
|---|---|---|---|---|
| 5,764,216 | A * | 6/1998 | Tanaka et al. | 345/87 |
| 6,275,207 | B1 | 8/2001 | Nitta et al. | |
| 7,279,057 | B2 * | 10/2007 | Reid et al. | 156/71 |
| 7,746,328 | B2 * | 6/2010 | Chen et al. | 345/204 |
| 7,768,487 | B2 * | 8/2010 | Jeon | 345/82 |
| 2002/0075215 | A1 * | 6/2002 | Willis | 345/89 |
| 2002/0163490 | A1 * | 11/2002 | Nose | 345/89 |
| 2003/0080931 | A1 * | 5/2003 | Chen et al. | 345/88 |
| 2003/0107542 | A1 * | 6/2003 | Abe et al. | 345/89 |
| 2003/0151667 | A1 * | 8/2003 | Nakami et al. | 348/207.1 |
| 2003/0169248 | A1 | 9/2003 | Kim et al. | |
| 2006/0145978 | A1 * | 7/2006 | Takatori et al. | 345/87 |
| 2007/0139328 | A1 * | 6/2007 | Lan | 345/89 |

* cited by examiner

*Primary Examiner* — Kimnhung Nguyen
(74) *Attorney, Agent, or Firm* — Jianq Chyun IP Office

(57) ABSTRACT

Gray scale distribution of an input image signal is obtained through statistics to determine the contrast characteristic of the input image signal. Based on the gray scale distribution, by a look up table, corresponding gamma setting values are derived and stored in a register. The register outputs the stored gamma setting values to a gray scale voltage generation circuit to adjust the gray scale voltage. Therefore, the display contrast and display quality are improved.

15 Claims, 5 Drawing Sheets

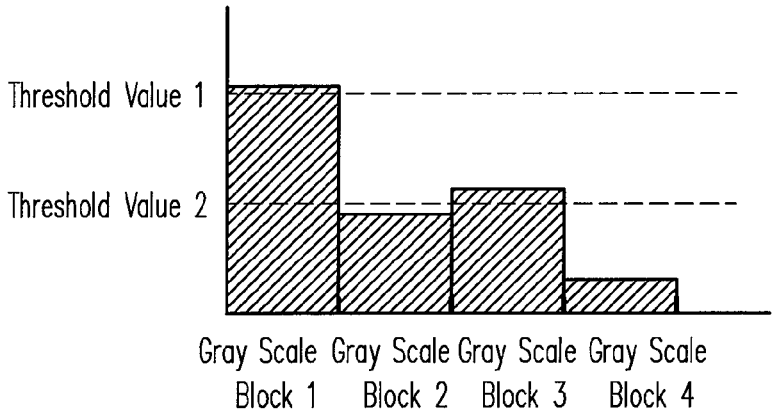
FIG. 2
| | | | | |
|---|---|---|---|---|
| Threshold Value 1 | 1 | 0 | 0 | 0 |
| Threshold Value 2 | 1 | 0 | 1 | 0 |
FIG. 3
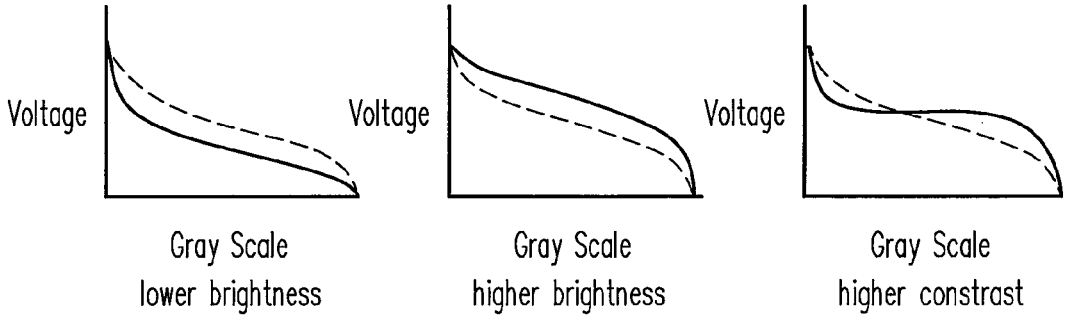
FIG. 4

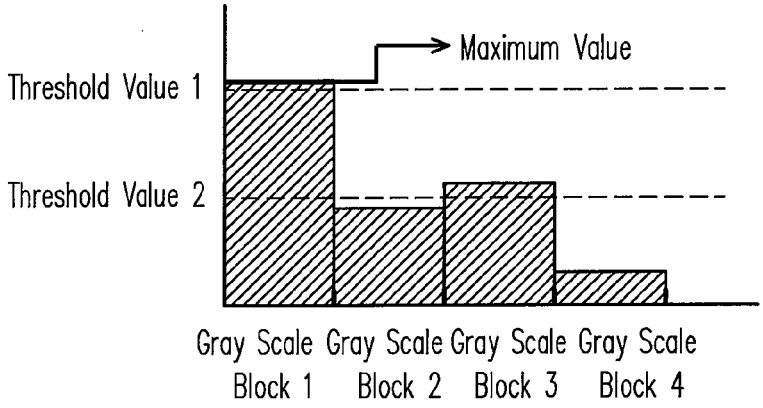
FIG. 6
| | | | | |
|---|---|---|---|---|
| Threshold Value 1 | 1 | 0 | 0 | 0 |
| Threshold Value 2 | 1 | 0 | 1 | 0 |
| | Maximum Value | | | |
FIG. 7
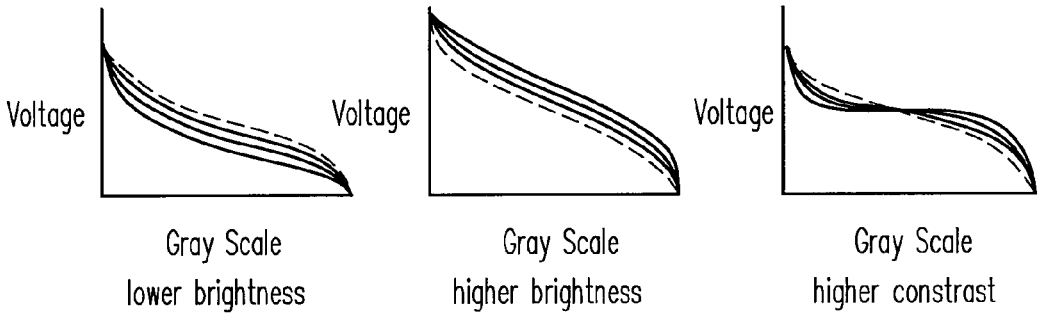
FIG. 8

IMAGE PROCESSING DEVICE AND METHOD THEREOF AND IMAGE DISPLAY DEVICE

CROSS-REFERENCE TO RELATED APPLICATION

This application claims the priority benefit of U.S. provisional application Ser. No. 60/864,977, filed on Nov. 9, 2006. The entirety of the above-mentioned patent application is hereby incorporated by reference herein and made a part of this specification.

BACKGROUND OF THE INVENTION

1. Field of the Invention

The present invention relates to an image processing device and a method thereof. More particularly, the present invention relates to a method and device for dynamically adjusting and improving image display contrast.

2. Description of Related Art

As the rapid development of electronic devices having display panels (e.g., wireless communication devices or PDAs), the demand for high-quality display on the electronic device becomes increasingly high. Therefore, it has become an issue to reduce the cost and to improve the image display quality.

Recently, adjustment of display brightness and color saturation has been developed. When a digital image data is input, a decoder converts the digital image data into an analog voltage signal based on voltages generated by a gray scale voltage generation circuit. It can be known that the gray scale voltages may affect brightness and color saturation of image display. In the state of the art, for example, U.S. Pat. No. 6,275,207 discloses that different setting of a register may change voltages generated by the gray scale voltage generation circuit, so as to increase the display brightness.

In US patent application publication 2003/0169248 A1, a contrast adjustment method is provided to calculate an average brightness Y of input images, in which $Y=CR*R+CG*G+CB*B$, R, G, and B are respectively average values of red, green, and blue gray scale values, and CR, CG, CB are respectively weights for the red, green, and blue. According to Y value, the brightness of the image frame is identified as being dark, bright, or normal. According to the determination result, gamma curve is modified to achieve the optimal display contrast. In the state of art, it requires complex average value calculation, so a larger integrated circuit area is required, and as a result, the circuit area and the manufacturing cost are increased.

Therefore, it is to provide an image processing device and a method thereof capable of dynamically adjusting and improving display contrast and display quality without complex architectures, so as to reduce the cost.

SUMMARY OF THE INVENTION

Accordingly, the present invention is directed to an image processing and a display mechanism, capable of improving image dynamic contrast and displaying high-quality image through simple operations and simple hardware architecture.

The present invention is also directed to an image processing and display mechanism, capable of displaying an image via a suitable gamma curve, by image recognition and threshold value comparison according to image characteristics, so as to dynamically adjust the image contrast.

The present invention is further directed to an image processing and display mechanism, capable of obtaining more suitable gamma curves by intensity analysis and approximation calculation in addition to the image recognition and threshold value comparison, so as to dynamically adjust the display contrast.

In an embodiment of the present invention, an image processing device is provided, which includes a gray scale distribution calculation unit, for receiving an input image signal which including color gray signals such as R, G, B gray scale values, and obtaining a gray scale distribution of the input image signal in a plurality of blocks; an image characteristic determination unit, for comparing the gray scale distribution of the input image signal in the blocks with a threshold value to obtain a comparison result, so as to determine a contrast characteristic of the input image signal; a look-up table unit, for storing a plurality of sets of gamma curve setting values, and outputting a set of gamma curve setting values in response to the comparison result; a register unit, for registering and outputting the set of gamma curve setting values output by the look-up table unit to a gray scale voltage generation circuit to generate a gray scale voltage. The gamma curve can be dynamically adjusted, so as to improve the display contrast and to enhance the frame quality. The image processing device may further includes an interpolation calculation unit, for performing interpolation on the set of gamma setting values output by the look-up table unit to obtain a new set of gamma setting values, so as to perform fine adjustment on the gamma curve. The gray scale voltage generation circuit further generates the gray scale voltage according to the fine-adjusted gamma curve. The gamma curve may be dynamically adjusted, so as to improve the display contrast and to enhance the display quality.

In another embodiment of the present invention, an image display device is provided, which includes a driving circuit, for receiving an input image and obtaining a suitable gamma curve by image recognition and threshold value comparison and/or intensity analysis, so as to dynamically adjust the image contrast; and a display panel, for displaying the input image according to a gray scale voltage generated by the driving circuit. The image display device is capable of dynamically adjusting the image contrast, and thus achieving an image display with high display contrast and high definition.

In still another embodiment of the present invention, an image processing method is provided, which includes: receiving an input image signal; obtaining a gray scale distribution of all pixels of the input image signal in a plurality of blocks; comparing the gray scale distribution of the input image signal with a threshold value to obtain a comparison result, so as to determine a contrast characteristic of the input image signal; selecting a set of gamma curve setting values from a plurality of sets of pre-stored gamma curve setting values in response to the comparison result; and generating a gray scale voltage in response to the selected set of gamma curve setting values. The image processing method further includes performing interpolation on the selected set of gamma curve setting values to obtain another set of gamma curve setting values, for performing the fine adjustment on the gamma curve.

In order to make the aforementioned and other objects, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 2 is a schematic view of gray scale distribution.

FIG. 3 is a schematic view of image characteristic comparison result.

FIG. 4 is a schematic view of a preset gamma curve.

FIG. 6 is a schematic view of gray scale distribution.

FIG. 7 is a schematic view of image characteristic determination result.

FIG. 8 is a schematic view of calculation result for gamma interpolation.

DESCRIPTION OF EMBODIMENTS

Figure 1:
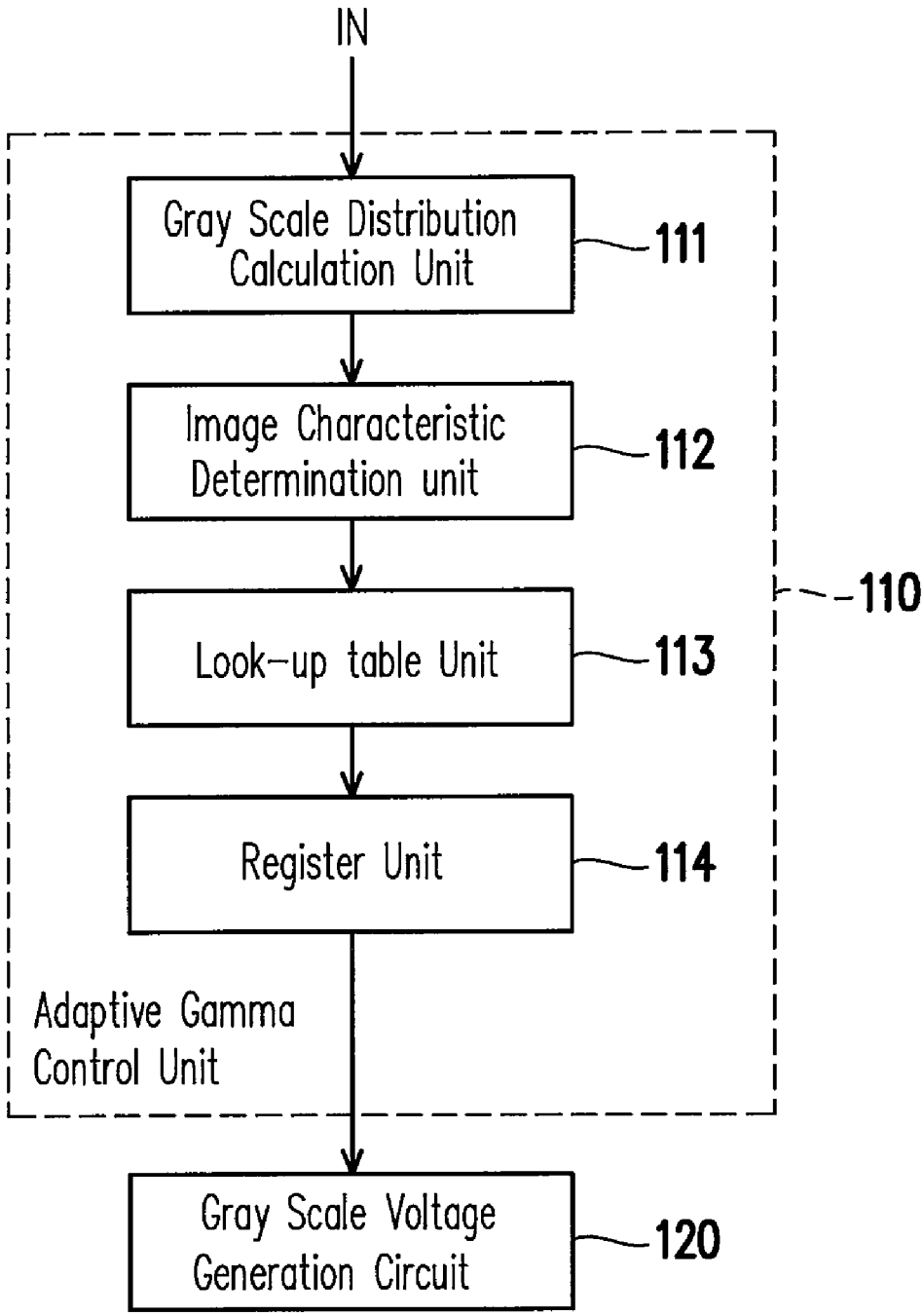
FIG. 1 is a schematic view of an adaptive gamma control unit according to a first embodiment of the present invention.

Reference will now be made in detail to the present embodiments of the invention, examples of which are illustrated in the accompanying drawings. Wherever possible, the same reference numbers are used in the drawings and the description to refer to the same or like parts.

In embodiments of the present invention, gray scale distribution of input image data is analyzed to predict gamma setting values, so as to change voltages generated by the gray scale voltage generation circuit. In this manner, the gamma curve may be dynamically adjusted, so as to improve brightness and color saturation of image display.

First Embodiment

In the first embodiment of the present invention, according to gray scale distribution characteristics of input images, an adaptive gamma control unit may dynamically change the gamma curve, so as to improve display contrast. FIG. 1 is a schematic block view of the adaptive gamma control unit according to the first embodiment of the present invention. Referring to FIG. 1, the adaptive gamma control unit 110 in the first embodiment of the present invention includes a gray scale distribution calculation unit 111, an image characteristic determination unit 112, a look-up table unit 113, and a register unit 114.

Referring to FIGS. 2 to 4, the operation of the first embodiment of the present invention is illustrated.

The gray scale distribution calculation unit 111 calculates the gray scale distribution of the input image IN. In the following description, it is assumed that the input image IN has 24 bit, in which the red gray scale value, green gray scale value, and blue gray scale value each has 8 bit. Therefore, the gray scale distribution corresponding to the input image IN is 0-255. The gray scale range of 0-255 is classified into a plurality of blocks. For example, gray scales 0 to 63 are classified as Block 1, gray scales 64 to 127 are classified as Block 2, gray scales 128 to 191 are classified as Block 3, and gray scales 192 to 255 are classified as Block 4. Of course, the way for block classification is not limited here.

In FIG. 2, an accumulative value of a block to which the gray scale of the input image IN belongs is added by 1. When all the R, G, B gray scale values of the input image are classified, the accumulative value of each block of the input image is obtained. For example, it is assumed that R, G, B gray scale values of a certain pixel of the input image IN are respectively 60, 100, and 150, and the accumulative values of Block 1, Block 2, and Block 3 are respectively added by 1. If the RGB gray scale values of a certain pixel of the input image IN are respectively 50, 60, and 70, the accumulative value of Block 1 is added by 2, and the accumulative value of Block 2 is added by 1. Further, as for an input image having resolution of 320*240, the sum of the accumulative values of Blocks 1-4 should be (320*240*3).

The image characteristic determination unit 112 determines the contrast characteristic of the input image. According to preset threshold values, the image characteristic determination unit 112 determines the gray scale distribution result obtained by the gray scale distribution calculation unit 111. If the accumulative value of the block is greater than the threshold value, the comparison result is set to be "1". If the accumulative value of the block is smaller than the threshold value, the comparison result is set to be "0". In this manner, the contrast characteristic of the input image is obtained. As shown in FIG. 3, the accumulative values of the Block 1 to Block 4 of FIG. 2 are compared with the threshold value 1 and the comparison result is [1, 0, 0, 0]. The accumulative values of the Block 1 to Block 4 are compared with the threshold value 2 and the comparison result is [1, 0, 1, 0]. According to the comparison results, the brightness of the input image can be known.

By looking up a table, the look-up table unit 113 selects one set from a plurality of sets of preset gamma setting values stored therein. The look-up table unit 113 pre-stores a plurality of sets of gamma setting values. Through a different gamma setting value, the gamma curve may be different, so the display contrast may be changed. As described above, the image characteristic determination unit 112 compares the block accumulative values with the threshold values to obtain the comparison result (for example, "10001010" as shown in FIG. 3). According to the comparison result, the look-up table unit 113 may select one set of gamma setting values from the sets of preset gamma setting values stored therein. The selected gamma setting values may be used to change the gray scale voltage, that is, to change the gamma curve.

In FIG. 4, the dashed line represents the preset gamma curve, and the solid line represents the gamma curve selected in this embodiment. The drawing on the left represents that the brightness is adjusted to be lower, the drawing in the middle represents that the brightness is adjusted to be higher, and the drawing on the right represents that dark pixels in the image are displayed as being darker than original and the bright pixels in the image are displayed as being brighter than original (i.e. contrast is to be higher).

The register unit 114 registers the set of gamma setting values selected by the look-up table unit 113. The register unit 114 outputs the selected set of gamma setting values to the gray scale voltage generation circuit 120. In this manner, the voltages generated by the gray scale voltage generation circuit 120 may be changed.

The gray scale voltage generation circuit 120 may include, for example, a plurality of sets of variable resistors connected in series. Each set of variable resistors is formed by serially connecting a plurality of parallel combinations of switches and resistors. In response to control signals (i.e., the selected gamma setting values), the switches are turned on or turned off, such that the resistance of the variable resistor is changed. Therefore, the gray scale voltage generation circuit 120 may set or change the generated gray scale voltages according to the gamma setting values output by the register unit 114.

According to this embodiment, the gamma curve may be dynamically adjusted according to the image characteristic of the input image, so as to improve the display contrast and to enhance the display quality.

Second Embodiment

Figure 5:
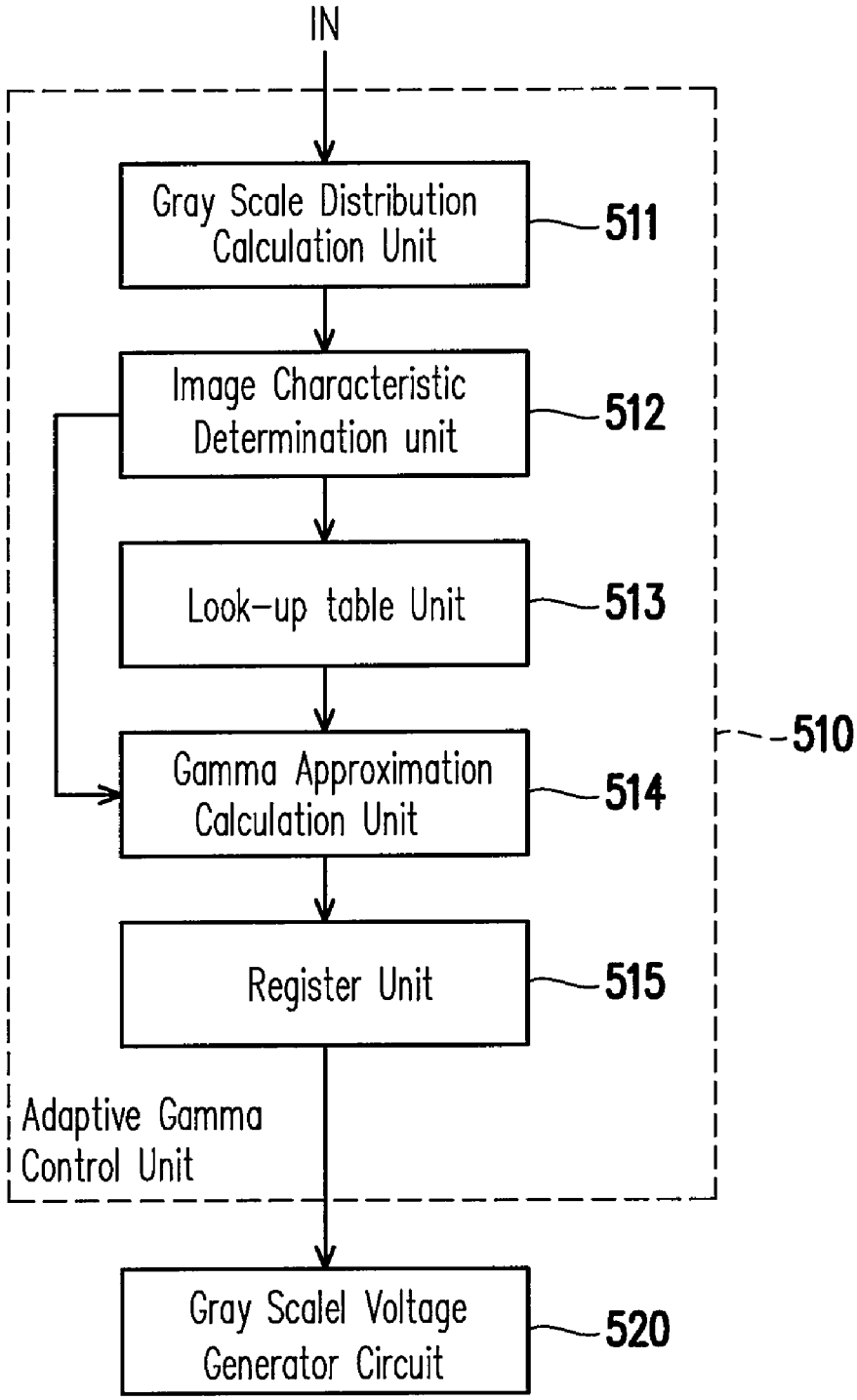
FIG. 5 is a schematic view of an adaptive gamma control unit according to a second embodiment of the present invention.

In the first embodiment, the display contrast is adjusted through using the gamma curve. Therefore, the number of the sets of the gamma setting values determines (limits) degree for the contrast fine-adjustment. In the second embodiment, approximate calculation is used to obtain more sets of gamma setting values, such that the flexibility for the display contrast adjustment becomes higher. FIG. 5 is a schematic block view of an adaptive gamma control unit 510 according to the second embodiment of the present invention. Referring to FIG. 5, the adaptive gamma control unit 510 in the second embodiment of the present invention includes a gray scale distribution calculation unit 511, an image characteristic determination unit 512, a look-up table unit 513, a gamma approximation calculation unit 514, and a register unit 515.

Referring to FIG. 4 and FIGS. 6-8, the operation of the second embodiment of the present invention is illustrated.

The operations of the gray scale distribution calculation unit 511 are similar to that of the gray scale distribution calculation unit 111, so the details are not repeated here.

Most operations of the image characteristic determination unit 512 are similar to that of the image characteristic determination unit 112, so the details are not repeated here. However, the image characteristic determination unit 512 obtains the maximum value of the accumulative values of all blocks, and the maximum value is defined as shown in FIG. 6.

By looking up a table, the look-up table unit 513 selects one set from a plurality of sets of preset gamma setting values. The image characteristic determination unit 512 compares the block accumulative values with the threshold values to obtain comparison result (for example, 10001010 as shown in FIG. 3). According to the comparison result, the look-up table unit 513 may select one set of gamma setting values from the plurality of sets of preset gamma setting values stored therein. The selected gamma setting values may be used to change the gray scale voltages, that is, to change the gamma curve.

The gamma approximation calculation unit 514 achieves fine adjustment on the gamma curve through approximation calculation (e.g., interpolation or extrapolation). The gamma approximation calculation unit 514 may perform approximation calculation according to the maximum value of the gray scale blocks, so as to obtain another set of gamma setting values that may represent the fine-adjusted gamma curve. The gamma curves corresponding to the gamma setting values approximated by the gamma approximation calculation unit 514 are shown by solid lines of FIG. 8.

The register unit 515 registers the gamma setting values calculated by the gamma approximation calculation unit 514 and outputs the set of gamma setting values to the gray scale voltage generation circuit 520, so as to change the voltages generated by the gray scale voltage generation circuit 520.

The architecture and operation of the gray scale voltage generation circuit 520 may be similar to that of the gray scale voltage generation circuit 120 of the first embodiment, so it is not repeated here.

According to this embodiment, the gamma curve can be dynamically adjusted according to the image characteristics of the input image and the gamma curves may be fine-tuned via approximation calculation, so as to further improve the display contrast and to further enhance the display quality.

Third Embodiment

Figure 9:
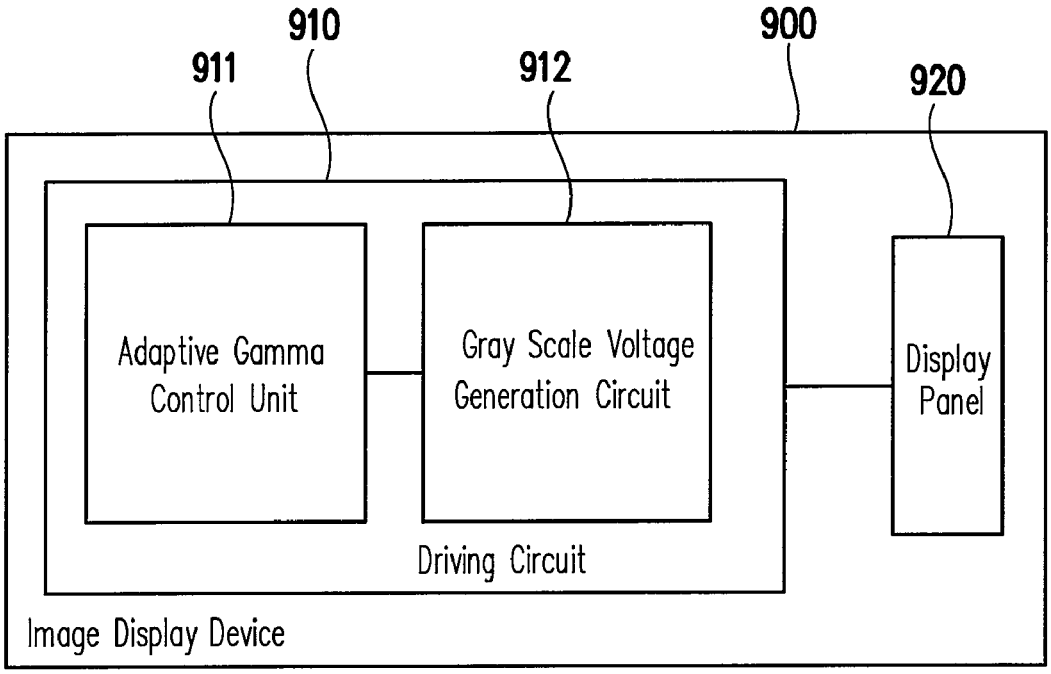
FIG. 9 is a block diagram of an image display device according to a third embodiment of the present invention.

FIG. 9 is a block diagram of an image display device according to a third embodiment of the present invention. Referring to FIG. 9, an image display device 900 includes a driving circuit 910 and a display panel 920. The driving circuit 910 further includes an adaptive gamma control unit 911 and a gray scale voltage generation unit 912. In this embodiment, the architecture and operation of the adaptive gamma control unit 911 may be similar to that of the adaptive gamma control unit 110 or 510 of the above embodiments, so it is not repeated here. That is, the driving circuit 910 not only drives the display panel 920 to display the image, but also has a function of dynamically adjusting gamma curves.

The display panel 920 displays the input image signal according to the gray scale voltages generated by the gray scale voltage generation unit 912. The display panel 920 may display the high-contrast color image.

To sum up, in the embodiments of the present invention, the image processing device and method thereof are provided. The gray scale distribution is determined through image recognition and the comparison result is sent to the look-up table unit to find out the corresponding gamma setting values, and meanwhile, the image intensity is determined through the image recognition, so as to obtain a set of gamma setting values. Even, approximation calculation (interpolation calculation or extrapolation calculation) may be performed on the above obtained gamma setting values, so as to obtain new gamma setting values for being stored into the register. Then, according to the looked-up or approximated gamma setting values, the gray scale voltages are changed. The gray scale distribution calculation unit utilizes simple accumulative calculation, without division, so the required space of the memory is saved and thereby cost is further reduced. The gamma curve is dynamically adjusted through look-up table and simple approximation calculation, so as to improve display quality and to achieve the optimal display contrast. In addition, the above embodiment of the present invention further provide an image display device with function of dynamically adjusting the gamma curve, which can achieve high display contrast and high definition.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An image processing device, capable of dynamically adjusting a display contrast of an input image signal, comprising:

a gray level distribution block calculating unit, for receiving the input image signal, and obtaining a gray level distribution of the input image signal according to a plurality of blocks;

an image characteristic determining unit, for comparing the gray level distribution with a critical value to obtain a determining result, so as to determine a contrast property of the input image signal;

a table look-up unit, for storing a plurality of sets of gamma curve setting values, and outputting a set of gamma curve setting values in response to the determining result;

a register unit, for registering and outputting the set of gamma curve setting values output by the table look-up unit; and a gray level voltage generator unit, for generating a gray level voltage in response to the set of gamma curve setting values output by the register unit.

2. The image processing device as claimed in claim 1, further comprising a calculating unit, for calculating another set of gamma curve setting values in response to the set of gamma curve setting values output by the register unit and then storing the another set of gamma curve setting values back to the register unit.

3. The image processing device as claimed in claim 2, wherein the register unit outputs the another set of gamma curve setting values to the gray level voltage generator unit.

4. The image processing device as claimed in claim 2, wherein the gray level voltage generator unit is made to generate the gray level voltage in response to the another set of gamma curve setting values output by the register unit.

5. The image processing device as claimed in claim 2, wherein the calculating unit comprises an interpolation calculating unit.

6. The image processing device as claimed in claim 2, wherein the calculating unit further calculates the another set of gamma curve setting values in response to a maximum accumulative value of the gray level distribution.

7. An image display device, capable of dynamically adjusting a display contrast of an input image signal, comprising:

a driving circuit, comprising:

a gray level distribution block calculating unit, for receiving the input image signal, and obtaining a gray level distribution of the input image signal according to a plurality of blocks;

an image characteristic determining unit, for comparing the gray level distribution with a critical value to obtain a determining result, so as to determine a contrast property of the input image signal;

a table look-up unit, for storing a plurality of sets of gamma curve setting values, and outputting a set of gamma curve setting values in response to the determining result;

a register unit, for registering and outputting the set of gamma curve setting values output by the table look-up unit; and a gray level voltage generator unit, for generating a gray level voltage in response to the set of gamma curve setting values output by the register unit; and a display panel, for displaying the input image signal according to the gray level voltage.

8. The image display device as claimed in claim 7, wherein the driving circuit comprises a calculating unit, for calculating another set of gamma curve setting values in response to the set of gamma curve setting values output by the register unit and then storing the another set of gamma curve setting values back to the register unit.

9. The image display device as claimed in claim 8, wherein the register unit outputs the another set of gamma curve setting values to the gray level voltage generator unit.

10. The image display device as claimed in claim 8, wherein the gray level voltage generator unit generates another gray level voltage in response to the another set of gamma curve setting values output by the register unit.

11. The image display device as claimed in claim 8, wherein the calculating unit comprises an interpolation calculating unit.

12. The image display device as claimed in claim 8, wherein the calculating unit further calculates the another set of gamma curve setting values in response to a maximum accumulative value of the gray level distribution.

13. An image processing method, comprising:

receiving an input image signal;

obtaining a gray level distribution of the input image signal according a plurality of blocks;

comparing the gray level distribution of the input image signal with a critical value to obtain a determining result, so as to determine a contrast property of the input image signal;

selecting a set of gamma curve setting values from a plurality of sets of pre-stored gamma curve setting values in response to the determining result;

generating a gray level voltage in response to the selected set of gamma curve setting values;

calculating another set of gamma curve setting values in response to the selected set of gamma curve setting values; and generating another gray level voltage in response to the another calculated set of gamma curve setting values.

14. The image processing method as claimed in claim 13, wherein the calculating step comprises an interpolation calculating step.

15. The image processing method as claimed in claim 13, further comprising:

calculating the another set of gamma curve setting values in response to a maximum accumulative value of the gray level distribution.

* * * * *